United States Patent [19]

Schueler et al.

[11] Patent Number: 4,964,789

[45] Date of Patent: Oct. 23, 1990

[54] FUEL INJECTION PUMP FOR INTERNAL COMBUSTION ENGINES

[75] Inventors: Hans Schueler, Ebersberg; Heinz Lauterbach, Esslingen; Helmut Tschoeke, Ostfildern; Richard Kinzel, Lautertal, all of Fed. Rep. of Germany; Theodor Stipek, Hallein, Austria

[73] Assignee: Robert Bosch GmbH, Stuttgart, Fed. Rep. of Germany

[21] Appl. No.: 302,286

[22] Filed: Jan. 27, 1989

[30] Foreign Application Priority Data

Feb. 17, 1988 [DE] Fed. Rep. of Germany ..... 3804843

[51] Int. Cl.[5] ..... F04B 7/04; F02M 59/26

[52] U.S. Cl. ..... 417/494; 417/499; 417/500; 123/300; 123/503

[58] Field of Search ..... 417/494, 499, 500, 501; 123/503, 500, 299, 300

[56] References Cited

U.S. PATENT DOCUMENTS

| | | | |
|---|---|---|---|
| 2,356,511 | 8/1944 | Descourtis | 417/494 |
| 2,420,164 | 5/1947 | Bremser | 417/494 |
| 3,963,384 | 6/1976 | Bastennof | 417/499 |
| 4,163,634 | 8/1979 | Powers | 417/499 |
| 4,187,060 | 2/1980 | Ellis et al. | 417/490 |
| 4,294,210 | 10/1981 | Bassoli et al. | 123/503 X |
| 4,531,488 | 7/1985 | Kawamura et al. | 123/300 |
| 4,611,566 | 9/1986 | Kampichler et al. | 123/506 |
| 4,830,587 | 5/1989 | Güntert et al. | 123/500 X |
| 4,881,506 | 11/1989 | Hoecker | 417/494 X |
| 4,897,024 | 1/1990 | Hatz et al. | 417/494 X |

FOREIGN PATENT DOCUMENTS

| | | |
|---|---|---|
| 2749693 | 6/1978 | Fed. Rep. of Germany . |
| 1571137 | 7/1980 | United Kingdom . |

*Primary Examiner*—Leonard E. Smith
*Assistant Examiner*—Eugene L. Szczecina, Jr.
*Attorney, Agent, or Firm*—Edwin E. Greigg

[57] ABSTRACT

A fuel injection pump for internal combustion engines has a pump piston that is axially and rotationally movable in a cylinder and has a control edge and a diversion edge that defines a recess in the jacket face of the pump piston. To limit and adjust the effective supply stroke, the control edge and the diversion edge cooperate with a control opening in the cylinder, which opening communicates with a fuel-filled low-pressure chamber. To prevent cavitation damage during the diversion process, a pre-diversion groove, which extends approximately parallel to the diversion edge, is provided in the portion of the jacket face of the pump piston defined by the control edge and the diversion edge. It is disposed at a distance from the diversion edge such that immediately before the entry of the diversion edge into the control opening, representing the onset of diversion, it connects the pump work chamber, which is at high pressure, to the control opening.

12 Claims, 2 Drawing Sheets

FUEL INJECTION PUMP FOR INTERNAL COMBUSTION ENGINES

BACKGROUND OF THE INVENTION

The invention relates to a fuel injection pump for internal combustion engines as generically defined hereinafter.

In such fuel injection pumps the high-pressure or positive-displacement chamber, or pump work chamber, is filled with fuel from the pump interior, which is a low-pressure chamber, via the uncovered control opening in the cylinder wall during the intake stroke of the pump piston, which is driven by a rotating control cam. The supply stroke begins as soon as the pump piston control edge has moved past the control opening and the control opening is closed by the pump piston jacket face. Since the entire stroke of the pump piston is always constant, the quantity of fuel pumped for injection from the high-pressure chamber upon each piston stroke can be varied by adjusting the usable supply stroke. This is done via the recess with the diversion edge, which defines the jacket face of the piston toward the recess. As soon as the diversion edge begins to slide via the control opening, the control opening communicates to an increasing extent with the high-pressure chamber, via the recess. Since the supply pressure is substantially higher than the pressure in the low-pressure chamber or pump interior, the fuel flows out of the high-pressure chamber suddenly, via the control opening, into the low-pressure chamber. The fuel supply is thus shut off instantly. By rotating the pump piston about its longitudinal axis, the instant at which the oblique or helical diversion edge slides past the control opening—and hence the end of supply—can be adjusted to later or earlier, with respect to the stroke period of the pump piston.

Because of the considerable pressure difference between the supply pressure in the high-pressure chamber and the fuel pressure in the low-pressure chamber, the outflow of the fuel via the control opening is so intensive upon the diversion, or in other words upon termination of the supply stroke, that eddy flows and negative-pressure zones are created at the control opening, which lead to cavitation at the piston jacket face. The formation of vapor bubbles can particularly be observed in the diversion process, and particularly when they implode they cause considerable damage to the control surface of the piston.

To diminish these phenomena, in a known fuel injection pump of this generic type (German Patent No. 27 49 693) the line or bore in the cylinder jacket connecting the control opening with the low-pressure chamber is divided into at least one feed branch and at least one outflow branch, and upon the initiation of the diversion process a connection is established between the feed branch and the outflow branch by means of the groove, which is closed at the end, in the piston face between the control edge and the diversion edge. As a result, fuel is supplied to the outflow branch from the feed branch during the diversion process, and as a result the eddy currents and negative-pressure zones are largely counteracted, consequently reducing the forces of cavitation.

In another known fuel injection pump (U.S. Pat. No. 4,163,634), the groove disposed between the control edge and the diversion edge in the pump piston jacket face serves not to prevent cavitation damage but rather to reduce the fuel supply quantity when the engine is under load and its rpm is accordingly dropping. To this end, the groove extends over part of the diversion edge and leaves open the part of the diversion edge that is operative during idling, or in other words that at the idling setting of the pump piston corresponds with the control opening. With one end, the groove is connected to the high-pressure chamber, and its other end is closed. It is disposed relative to the diversion edge in such a way, and is dimensioned in such a way that from a particular point on the supply stroke until the end of the supply stroke, it is located in the vicinity of the control opening and allows some of the fuel in the high-pressure chamber to flow out via the control opening. The groove is inoperative during idling of the fuel injection pump.

OBJECT AND SUMMARY OF THE INVENTION

The fuel injection pump according to the invention has the advantage that damage to the piston faces is avoided by simple means. By means of the pre-diversion groove, fuel is pumped from the high-pressure chamber into the control opening prior to the actual diversion process; as a result, hollows in the control opening are flushed out prior to the actual onset of diversion, so that the vapor bubbles that form can be shifted away from the piston face to a region located farther away from it. If the pre-diversion groove is embodied in accordance with a particularly advantageous embodiment of the invention, such that it communicates at one end with the high-pressure chamber and is closed at the other end, then the fuel located in the control bore begins to rotate because of the one-sided access. The resultant swirl flow substantially improves the flushing of the vapor bubbles away from the low-flow region of the piston and control opening.

By embodying the pre-diversion groove such that it is deeper and/or wider in the region of the diversion edge that is operative at long pump piston supply strokes than in the region of the diversion edge that is operative at short pump piston supply strokes, or by omitting the pre-diversion groove in the region of the diversion edge that is operative at short pump piston supply strokes, the influence on fuel injection quantity metering tolerances, which is particularly problematic at short supply strokes, of the fuel quantity diverted via the pre-diversion groove for flushing purposes is kept slight. Moreover, the cavitation problems at short supply strokes are disproportionately less than at long supply strokes, so that the reduction in damage, which is the intended object, is not notably impaired.

Suitable dimensions of the pre-diversion groove are also disclosed in this application.

The invention will be better understood and further objects and advantages thereof will become more apparent from the ensuing detailed description of preferred embodiments taken in conjunction with the appended drawings.

DESCRIPTION OF THE PREFERRED EMBODIMENTS

Figure 1:
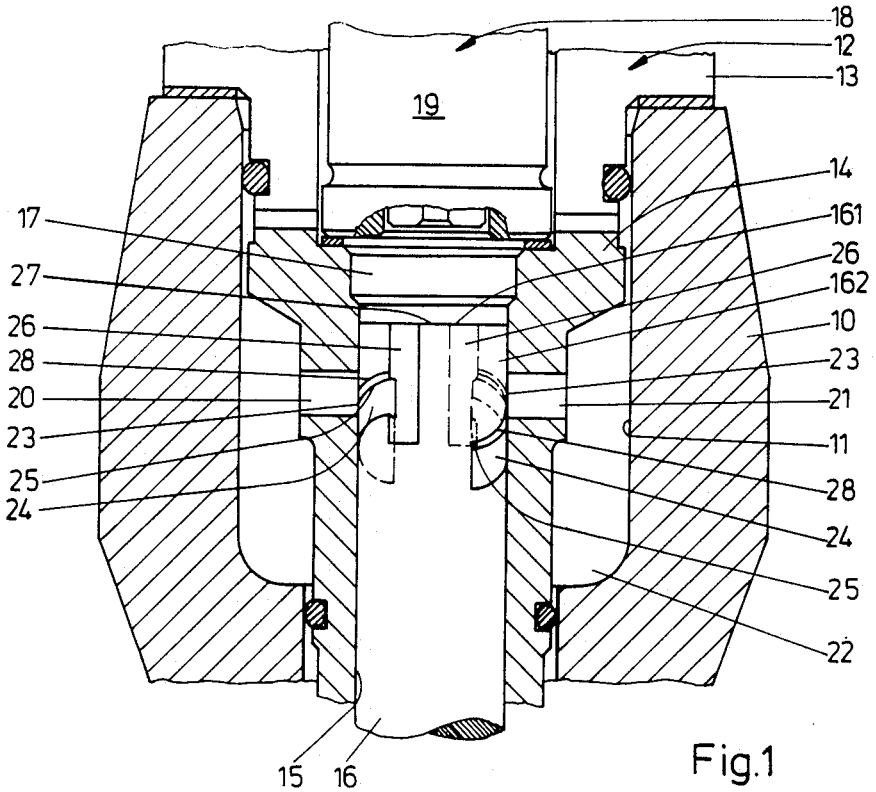
FIG. 1 is a detail of a longitudinal section through a fuel injection pump.

The fuel injection pump shown only in part in FIG. 1 has a cast aluminum pump housing 10, having a receiving bore 11 into which a pump element 12, shown only in part, is inserted and is secured in a known manner by means of a flange 13. The pump element 12 comprises a cylinder liner 14, onto which the flange 13 is integrally formed, a pump piston 16 that is axially and rotationally movable in the cylinder bore 15 of the cylinder liner 14, and a pressure valve 18, which is screwed with its pressure valve housing 19 in a portion of enlarged diameter of the cylinder bore 15 and together with the pump piston 16 defines a pump work chamber 17. Two diametrically opposed control bores 20, 21 are disposed in the cylinder bush 14 and communicate with a return chamber 22 that at the same time serves as a suction chamber. Each control bore 20, 21 discharges with a control opening 23 in the cylinder bore 15. The return chamber 22 communicates in a manner known per se via a connecting line, not shown, with the pump interior, which is filled with fuel by a fuel feed pump and is at a pressure of approximately 2 to 5 bar.

Two recesses 24, embodied as oblique or helical grooves, are machined into the jacket face 162 of the pump piston 16, and the boundary of the recesses on the jacket face 162 of the pump piston 16 forms a diversion opening 25. Each recess 24 communicates continuously with the pump work chamber 17, via a stop groove 26 machined in the form of a longitudinal groove into the pump piston 16. Instead of the stop groove 26, an axial bore may be provided. The leading boundary edge of the jacket face 162, located at the end face 161 of the pump piston 16 that defines the pump work chamber 17, forms the control edge 27 of the pump piston 16. During the axial stroke of the pump piston 16, the portion of the jacket face 162 of the pump piston 16 located between the control edge 27 and the diversion edge 25 closes the control opening 23 of each control bore 20, 21. At bottom dead center of the pump piston 16, the control edge 27 is located in the vicinity of the control openings 23, so that fuel can flow out of the fuel-filled return chamber 22 into the pump work chamber 17. During the effective supply stroke, the control openings 23 are closed by the jacket face 162 of the pump piston 16, and upon the end of the effective supply stroke, one control edge 25 at a time reaches the vicinity of a control opening 23; as a result, via the stop groove 26 and the recess 24, communication between the pump work chamber 17 and the control opening 23 is re-established. The fuel that is at high pressure in the pump work chamber 17 can now flow out suddenly into the return chamber 22 via the control bores 20, 21. Since the axial piston stroke is constant, the pump piston 16 is rotated about its longitudinal axis in order to adjust the effective supply stroke of the pump piston 16, so that the diversion edge 25 reaches the vicinity of the control opening 23 at an earlier or later time during the pump piston stroke. The end of supply is accordingly earlier or later as well.

Figure 2:
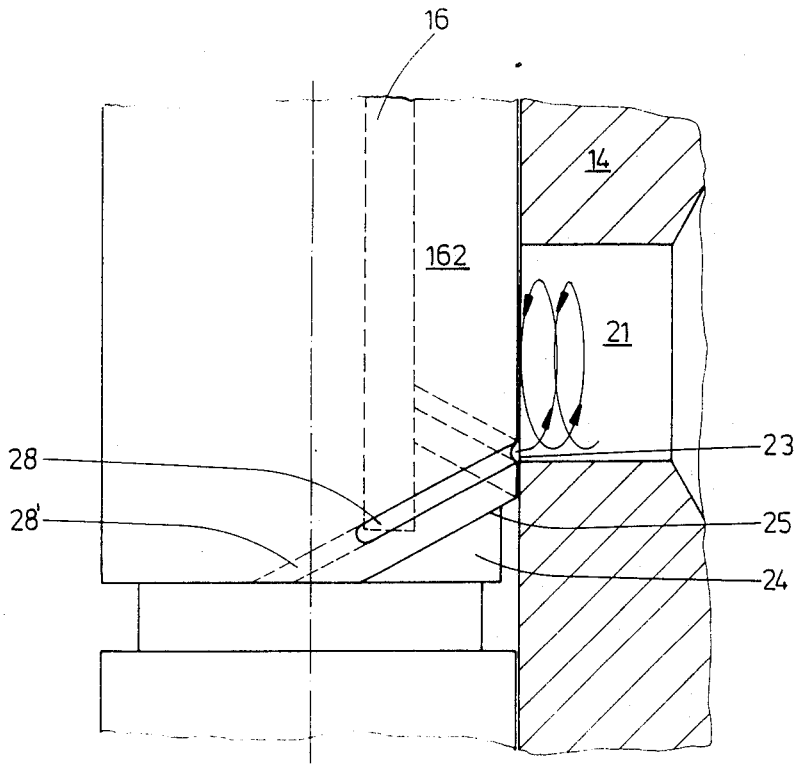
FIG. 2 is a view on a larger scale of the area marked II in FIG. 1.

To avoid cavitation damage at the jacket face 162 of the pump piston 16 and in the vicinity of the control bores 20, 21 directly at the control opening 23 from imploding vapor bubbles, a pre-diversion groove 28 is provided in the portion of the jacket face between the diversion edge 25 and the control edge 27. One pre-diversion edge 28′ is assigned to each diversion edge 25 and extends approximately parallel to it, preferably over its entire length. The pre-diversion groove 28 discharges at one end into the stop groove 26 (FIG. 1) and is closed at its other end (FIG. 2). The distance by which the pre-diversion groove 28 is spaced apart from each control edge 27 is selected such that the pre-diversion groove 28 reaches the vicinity of the control opening 23 immediately before the appearance of the diversion edge 25, thereby already connecting the pump work chamber 17 to the control opening 23 immediately prior to the actual onset of diversion. Thus a metered quantity of fuel at high pressure already flows out into the control opening 23 immediately prior to the onset of diversion and shifts the negative-pressure zones and vapor bubbles that are forming or may have formed into the interior of the control bores 20, 21, so that imploding vapor bubbles cannot cause any cavitation damage at the jacket face 162 of the pump piston 16. The pre-diversion groove 28 is suitably embodied such that it is deeper and/or wider, in the zone of the diversion edge 25 that is operative at long supply strokes of the pump piston 16, than in the zone of the diversion edge 25 that is operative at shorter supply strokes of the pump piston 16. As a result, the quantity of fuel flowing into the control opening 23 immediately prior to the onset of diversion is dimensioned such that it is large at long supply strokes and vanishingly small at short supply strokes. In this way, tolerance problems in metering the fuel injection quantity during the supply stroke of the pump piston 16 are kept within limits; since the fuel flowing out for flushing purposes via the pre-diversion groove 28 is missing from the metered supply quantity, the outflowing fuel quantity for flushing is much more critical at short effective supply strokes than at long ones. Correspondingly, by the described embodiment of the pre-diversion groove 28, the flushing fuel quantity at long supply strokes is dimensioned substantially larger than at short supply strokes. To facilitate manufacture of the pre-diversion stroke 28, it can be made constant in width and depth, but then extends not over the entire length of the diversion edge 25, but instead only over that portion of it that is operative at medium and long supply strokes. In the range of short supply strokes, the pre-diversion groove 28 is not operative.

The following dimensions of the pre-diversion groove 28 have proved to be particularly effective: The spacing of the pre-diversion groove 28 from the diversion edge 25 amounts to approximately 20 to 50% of the inside diameter of the control opening 23. The width of the pre-diversion groove 28 is approximately 20 to 50% the diameter of the control opening 23. The depth of the pre-diversion groove 28 is approximately 2 to 20% of the diameter of the control opening 23.

Instead of the pre-diversion groove 28 being closed at one end and communicating at the other end, via the stop groove 26, with the high-pressure chamber or pump work chamber 17, the pre-diversion groove 28′ can also communicate at both ends with the pump work chamber 17. In that case, the fuel emerging from the pre-diversion groove 28′ into the control opening 23 will not flow away in a kind of swirl flow over the jacket face 162 of the pump piston 16, as shown schematically in FIG. 2, and which is particularly advantageous for flushing away the negative-pressure zones and vapor bubbles from the jacket face 162 of the pump piston 16, but nevertheless, the fuel separating from the pre-diversion groove 28 still flushes these zones and vapor bubbles into the interior of the control bores 20, 21. In both cases, the cross section of the groove may be rectangular or in the form of part of a circle. The continuous pre-control groove 28′ is shown in dot-dash lines in FIG. 2 and in solid lines in FIG. 3.

Figure 3:
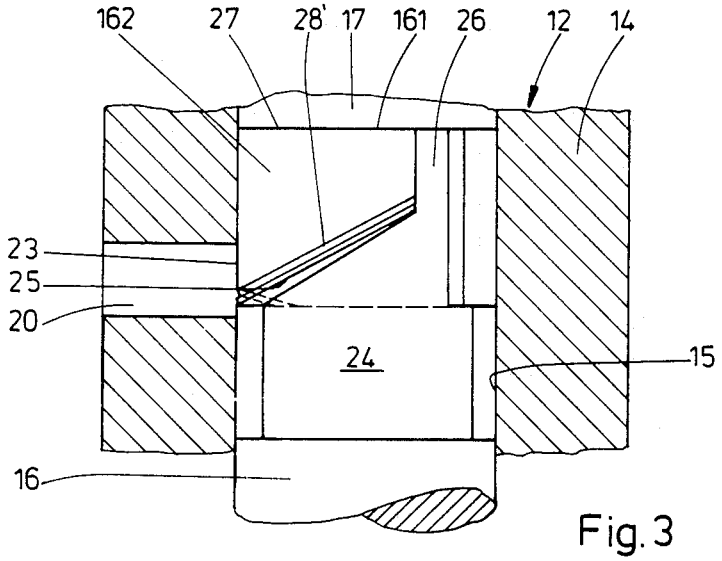
FIG. 3 is a fragmentary longitudinal section of a pump element of the fuel injection pump of FIG. 1 in a further exemplary embodiment.

FIG. 3 shows a modification of the pump element 12. Here, only one control bore 20 and one control opening 23 are provided. Correspondingly, there is only a single recess 24 on the pump piston 16, which recess communicates continuously with the pump work chamber 17 via the stop groove 26. The recess 24 is defined by a diversion edge 25 in the same manner. The pre-diversion groove 28′ extends parallel to the diversion edge 25, and discharges at one end into the stop groove 26 and at the other into the recess 24.

The foregoing relates to preferred exemplary embodiments of the invention, it being understood that other variants and embodiments thereof are possible within the spirit and scope of the invention, the latter being defined by the appended claims.

What is claimed and desired to be secured by letters patent of the U.S. is:

1. A fuel injection pump for internal combustion engines having an axially reciprocating pump piston (16) including a jacket face (162) guided in a cylinder (14) and including an end face (161)which defines a high-pressure chamber (17), at least one recess (24) on the jacket face of said pump piston arranged to communicate continuously with the high pressure chamber via a stop groove (26), said at least one recess having a diversion edge (25), said pump piston further being rotatable about its longitudinal axis for adjustment of the usable supply stroke having at least one control bore (20, 21) having a control opening (23) in the cylinder wall arranged to cooperate with the pump piston and further adapted to communicate with a low-pressure chamber (22) with said supply stroke of the pump piston being closed by the pump piston jacket face after a control edge (27) disposed near the piston end face which defines said high-pressure chamber has moved there past, said supply stroke further being uncovered toward said high-pressure chamber upon passage of said diversion edge, a pre-diversion groove (28) in said jacket face of said pump piston to reduce cavitation damage, further in which said pre-diversion groove (28) has an upper open end closest to said end face (161) which communicates continuously with said high-pressure chamber (17) via said stop groove (26) and includes a closed end on said jacket face, said pre-diversion groove (28) is spaced apart by a distance from the diversion edge (25) which is approximately 20 to 50% of a diameter of said control opening (23) such that, immediately before the entry of the diversion edge (25) into the control opening (23), said pre-diversion groove (28), connects the high-pressure chamber (17) to the control opening (23).

2. A pump as defined in claim 1, in which the pre-diversion groove (28) extends over the entire length of the diversion edge (25).

3. A fuel injection pump as set forth in claim 2 which includes two recesses (24), two diversion edges (25), two control edges (27), two stop grooves (26), two pre-diversion grooves (28) and two control openings (20, 21).

4. A pump as defined by claim 2, in which said pre-diversion groove (28) is deeper more voluminous in the portion of the diversion edge (25) that is operative at long effective supply strokes of the pump piston (16) than in the portion of the diversion edge (25) that is operative at short effective supply strokes of the pump piston (16).

5. A fuel injection pump as set forth in claim 4 which includes two recesses (24), two diversion edges (25), two control edges (27), two stop grooves (26), two pre-diversion grooves (28) and two control openings (20, 21).

6. A pump as defined by claim 1, in which said pre-diversion groove (28) extends only over a portion of said diversion edge (25) that is operative at medium to long supply strokes of the pump piston (16).

7. A fuel injection pump as set forth in claim 6 which includes two recesses (24), two diversion edges (25), two control edges (27), two stop grooves 926), two pre-diversion grooves (28) and two control openings (20, 21).

8. A pump as defined by claim 1, in which said pre-diversion groove (28) has a width which is approximately 20 to 50% of the diameter of the control opening (23).

9. A fuel injection pump as set forth in claim 8 which includes two recesses (24), two diversion edges (25), two control edges (27), two stop grooves (26), two pre-diversion grooves (28) and two control openings (20, 21).

10. A pump as defined by claim 1, in which said pre-diversion groove (28) has a depth which is approximately 2 to 20% of the diameter of the control opening (23).

11. A fuel injection pump as set forth in claim 10 which includes two recesses (24), two diversion edges (25), two control edges (27), two stop grooves (26), two pre-diversion grooves (28) and two control openings (20, 21).

12. A fuel injection pump as set forth in claim 1 which includes two recesses (24), two diversion edges (25), two control edges (27), two stop grooves (26), two pre-diversion grooves (28) and two control openings (20, 21).

* * * * *